US005632348A

United States Patent [19]

Yunan

[11] Patent Number: 5,632,348

[45] Date of Patent: May 27, 1997

[54] FLUID ACTIVATED DETONATING SYSTEM

[75] Inventor: Malak E. Yunan, Boonton Township, N.J.

[73] Assignee: Conoco Inc., Ponca City, Okla.

[21] Appl. No.: 343,459

[22] PCT Filed: Oct. 7, 1993

[86] PCT No.: PCT/US93/09683

§ 371 Date: Mar. 18, 1996

§ 102(e) Date: Mar. 18, 1996

[87] PCT Pub. No.: WO95/09969

PCT Pub. Date: Apr. 13, 1995

[51] Int. Cl.[6] ..... E21B 43/1185

[52] U.S. Cl. ..... 175/4.54; 102/200; 166/63; 166/299

[58] Field of Search ..... 175/4.52, 4.54; 102/205, 702, 204, 216, 275, 275.11, 202.5, 202.7, 200; 166/63, 299

[56] References Cited

U.S. PATENT DOCUMENTS

| | | | |
|---|---|---|---|
| 3,329,218 | 7/1967 | Bell | 175/4.54 |
| 3,468,386 | 9/1969 | Johnson | 175/4.6 |
| 4,612,857 | 9/1986 | Schimmel | 102/204 |
| 4,886,126 | 12/1989 | Yates, Jr. | 175/4.54 |
| 5,046,567 | 9/1991 | Aitken et al. | 175/4.6 |
| 5,228,518 | 7/1993 | Wilson et al. | 166/369 |
| 5,346,016 | 9/1994 | Wilson et al. | 166/380 |

*Primary Examiner*—Hoang C. Dang

*Attorney, Agent, or Firm*—John E. Holder

[57] ABSTRACT

A fluid actuated detonating device is shown being used to activate explosive devices in a borehole. The detonating device has an explosive detonation charge arranged in a housing wherein a rupture disc in the wall of the housing separates the explosive charge from a fluid environment so that when pressure in the fluid environment is raised to a sufficient level the rupture disc fails and communicates a sudden pressure wave to the explosive to detonate the explosive.

15 Claims, 5 Drawing Sheets

FLUID ACTIVATED DETONATING SYSTEM

FIELD OF THE INVENTION

This invention relates a fluid activated detonating system and more particularly to detonating an explosive device by producing a sudden pressure wave or pulse.

BACKGROUND OF THE INVENTION

In the process of establishing an oil or gas well, the well is typically provided with an arrangement for selectively excluding fluid communication with certain zones in the formation to avoid communication with undesirable fluids. A typical method of controlling the zones with which the well is in fluid communication is by running well casing down into the well and then sealing the annulus between the exterior of the casing and the walls of the wellbore with cement. Thereafter, the well casing and cement may be perforated at preselected locations by a perforating device or the like to establish a plurality of fluid flow paths between the pipe and the product bearing zones in the formation. Unfortunately, the process of perforating through the casing and then through the layer of cement dissipates a substantial portion of the energy from the perforating device and the formation receives only a minor portion of the perforating energy.

Perforating in wellbores is typically accomplished by the use of perforating guns which usually employ shaped charges or bullets. The guns are usually positioned in the wellbore on a tubing string or suspended from a cable. Detonating the explosive in the gun is sometimes accomplished by initiating a detonating cord which is positioned adjacent a shaped charge. Various electrical, hydraulic and mechanical systems are employed to initiate the detonating cord. The detonating systems which are now used in this industry have many safety drawbacks especially when electrical energy is used to initiate the process. Accordingly, it is an object of the present invention to provide a new and improved system to initiate an explosive device.

It is a further object to provide a system to safely initiate an explosive device at a remote location as, for example, in a wellbore.

Additionally, it is an object of the present invention to provide a method and apparatus for perforating a wellbore which overcomes or avoids the above noted limitations and disadvantages of the prior art.

It is yet another object of the present invention to provide a method and apparatus for detonating explosive charges by a pressure wave or pulse.

SUMMARY OF THE INVENTION

The above and other objects and advantages of the present invention have been achieved in the embodiments illustrated herein by the provision of an apparatus and method for detonating an explosive charge by means of a pressure pulse or shock wave, and additionally by positioning a pressure pulse generating device in proximity to but spaced from the explosive charge.

Additionally, the charges may be placed in the walls of a casing string in a wellbore and a pressure pulse generating device is run into the casing string in a separate operation.

In one embodiment, an explosive detonator is arranged in a housing having a rupture in communication with a fluid environment so that when the rupture means is subjected to a sufficient pressure, the rupture device will rupture to subject the detonator to a sudden pressure wave.

In another embodiment, the system comprises an explosive device mounted in an opening in the peripheral wall of a pipe. An initiation device is then positioned in the wellbore for detonating the explosive device.

According to another aspect, the invention is an improved detonator device adapted for detonation by a predetermined pressure generated from a remote source when the detonator is in contact with a fluid environment. The detonator device, which is conveniently mountable adjacent to an explosive charge, such as a shaped charge explosive of the type described hereinabove, comprises a housing which contains a base charge of a detonating explosive and a priming charge of a heat sensitive explosive adjacent to the base charge. The housing adjacent the priming charge is sealed from the fluid environment by a rupturable membrane or rupturable disc. Optionally, the detonator may include an open volume between the priming charge and the rupturable disc. Generation of a pressure pulse from any convenient pulse generator, such as, for example, a detonating cord, at any remote location within the fluid and the subsequent sudden impact of the pulse on the rupturable disc reliably initiates the priming charge.

DETAILED DESCRIPTION OF THE PREFERRED EMBODIMENTS

Figure 1:
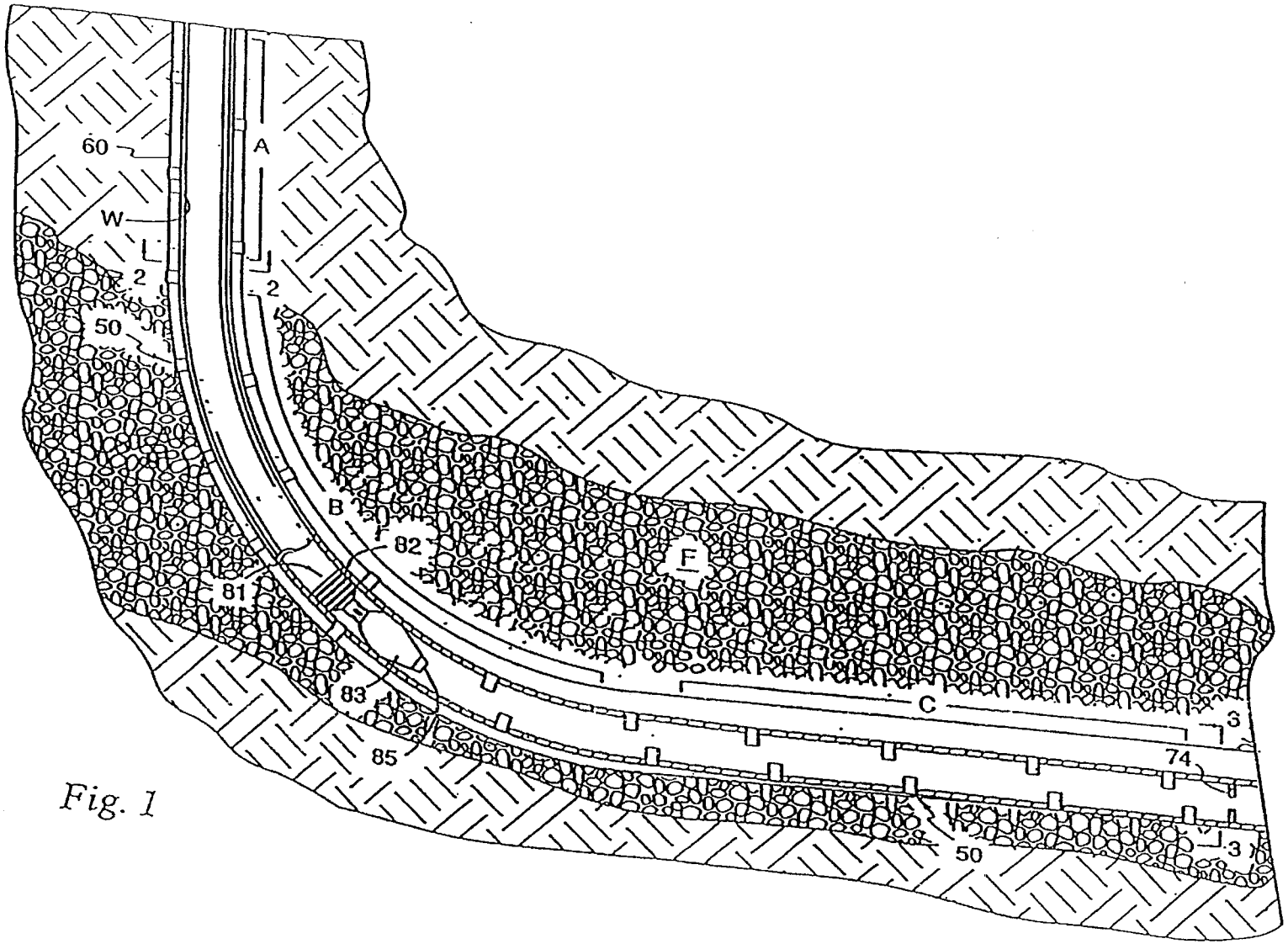
FIG. 1 is a cross-sectional view of a wellbore traversing earth formations with a casing string arranged therein and spaced from the walls of the wellbore by a plurality of downhole activated pistons which are shown being activated to an extended position and which embody features of the present invention.

Referring first to FIG. 1 of the drawings, a wellbore W is shown having been drilled into the earth formations such as for the exploration and production of oil and gas. The illustrated wellbore W includes a generally vertical section A, a radial section B leading to a horizontal section C. The wellbore has penetrated several formations, one of which may be a hydrocarbon-bearing zone F. Moreover, the wellbore W was drilled to include a horizontal section C which has a long span of contact with the formation F of interest, which may be a hydrocarbon-bearing zone. With a long span of contact within a pay zone, it is likely that more of the hydrocarbon present will be produced. Unfortunately, there are adjacent zones which have fluids such as brine that may get into the production stream and thereafter have to be separated from the hydrocarbon fluids and disposed of at additional costs. Accordingly, fluid communication with such adjacent zones is preferably avoided.

To avoid such communication with nonproduct-bearing zones, wellbores are typically cased and cemented and thereafter perforated along the pay zones. However, in the highly deviated portions of a wellbore such as the radial section B and the horizontal section C of the wellbore, the casing tends to lay against the bottom wall of the wellbore, thereby preventing cement from encircling the casing and leaving a void for wellbore fluids such as brine to travel along the wellbore and enter the casing far from the formation from which it is produced. In the illustrated wellbore W, a casing string or liner 60 has been run therein which is spaced from the walls of the wellbore by a plurality of downhole activated pistons generally indicated by the number 50, which serve to centralize the casing. The downhole activated pistons or centralizers 50 are retracted into the casing 60 while it is being run into the wellbore as is illustrated by the centralizers 50 in FIG. 1 which are ahead of an activator or pusher 82. Once the casing 60 is suitably positioned, the centralizers 50 are deployed to project outwardly from the casing as illustrated behind the activator or in FIG. 1. The centralizers 50 move the casing from the walls of the wellbore if the casing 60 is laying against the wall or if the casing is within a predetermined proximity to the wall of the wellbore W. This movement away from the walls of the wellbore will thereby establish an annular free space around the casing 60. The centralizers 50 maintain the spacing between the casing 60 and the walls of the wellbore W while cement is injected into the annular free space to set the casing 60. The pistons, however, are latched in an extended position and will thereby maintain the casing 60 centered even if the casing is not cemented.

Figure 3:
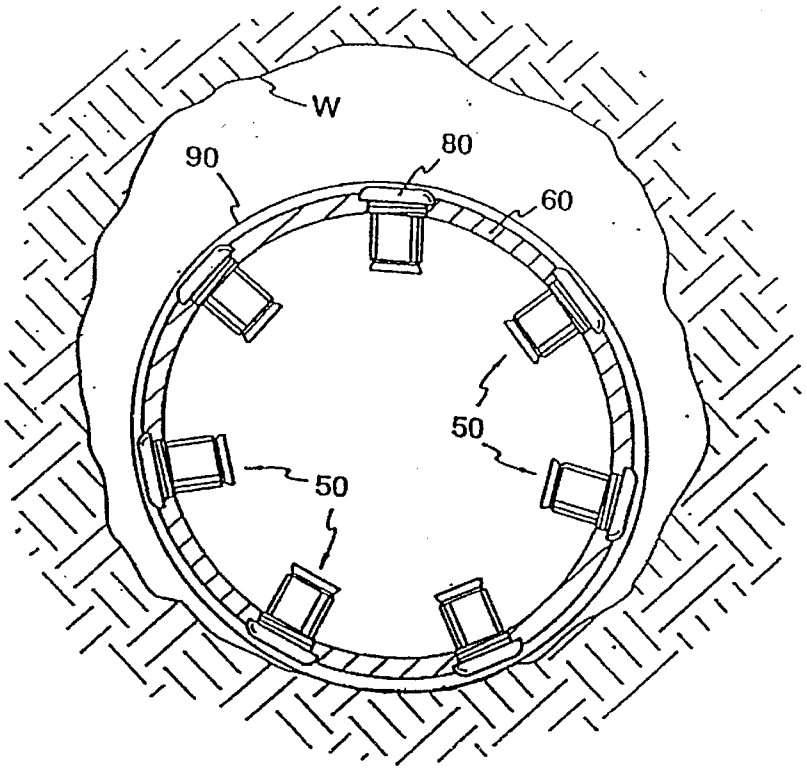
FIG. 3 is a cross-sectional end view similar to FIG. 2 prior to the casing being centralized and with the downhole activated centralizers in the retracted position.
Figure 2:
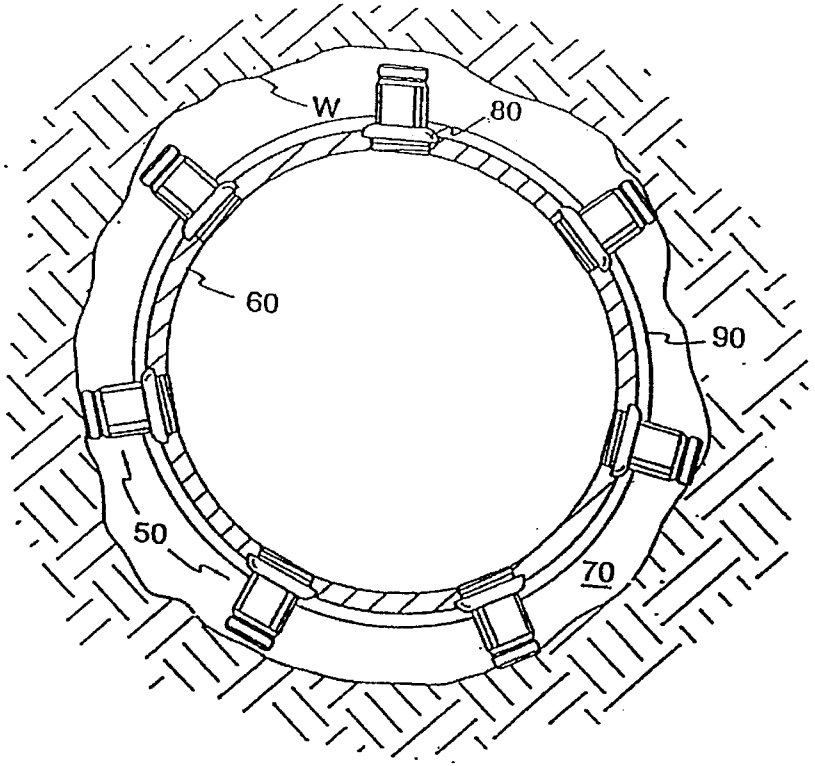
FIG. 2 is an enlarged cross-sectional end view of the casing taken along lines 2—2 in FIG. 1, wherein the centralizers are shown extended to center the casing string in the wellbore.

The centralizers 50 are better illustrated in FIGS. 2 and 3 wherein they are shown in the extended and retracted positions, respectively. Referring specifically to FIG. 2, seven centralizers 50 are illustrated for supporting the casing 60 away from the walls of the wellbore W although only four are actually shown contacting the walls of the wellbore W. It should be recognized and understood that the centralizers work in a cooperative effort to centralize the casing 60 in the wellbore W. The placement of the centralizers 50 in the casing 60 may be arranged in any of a great variety of arrangements. In particular, it is preferred that the centralizers 50 be arranged to project outwardly from all sides of the periphery of the casing 60 so that the casing 60 may be lifted away from the walls of the wellbore W no matter the rotational angle of the casing 60. It is also preferred that the centralizers 50 be regularly spaced along the casing 60 so that the entire length of the casing 60 is centralized. The distance between centralizers and their radial orientation on the casing will vary depending upon the circumstances of a particular completion. For example, it is conceivable that the centralizers may be provided only in one radial orientation, or only at the ends of a section of casing. In Applicants' copending U.S. Pat. No. 5,346,016, incorporated herein by reference, various arrangements are shown for mounting centralizer pistons in the wall of a pipe string.

Referring again to FIGS. 2 and 3, the 7 illustrated centralizers 50 are evenly spaced around the casing 60. As the casing is centralized, an annular space 70 is created around the casing within the wellbore. The casing 60 is run into the wellbore with the centralizers 50 retracted as illustrated in FIG. 3 which allows substantial clearance around the casing 60 and permit the casing 60 to follow the bends and turns of the wellbore W. Such bends and turns particularly arise in a highly deviated or horizontal hole. With the centralizers 50 retracted, the casing 60 may be rotated and reciprocated to work it into a suitable position within the wellbore. Moreover, the slim dimension of the casing 60 with the centralizers 50 retracted (FIG. 3) may allow it to be run into wellbores that have a narrow dimension or that have narrow fittings or other restrictions.

In FIGS. 2 and 3 and in subsequent figures as will be explained below, the centralizers 50 may present small bulbous portions 80 on the outside of the casing 60. It is preferable not to have any dimension projecting out from the casing to minimize drag and potential hangups while moving the string. The outward projection of the retracted centralizers 50 being within the maximum outer profile of the casing string 60 is believed to minimize any problems of running the casing.

Referring again to FIG. 1, a deploying device or pusher 82 which moves from the top of the casing to its bottom end is shown positioned within the horizontal curved section B of the casing string. The deploying device 82 is sized to push the pistons 50 from a retracted to an extended position. It is noted that the centralizers or pistons 50 behind or to the left of the pusher 82 are in an extended position having been engaged by the tapered nose portion 85 of the pusher. The tapered portion 85 engages the inner ends of the pistons and pushes them outwardly as the piston travels until the body portion 83 has passed the piston whereupon the piston will be fully extended and locked into an extended position as will be hereinafter described. The centralizers in front of the pusher 82 are still in a retracted position and consequently the horizontal portion C of the casing in front of the pusher is shown lying on the bottom side of the borehole. The upper vertical section A and radial section B are shown centered in that the pistons 50 have been deployed to an extended position. The activator device shown in FIG. 1 is a pumpable activator or deploying device having a tail pipe 81 which extends rearwardly from the main body portion 83 and seals the rear end of the device to the inside of the casing so that the device may be pushed down through the casing 60 by the application of hydraulic pressure.

Figure 4:
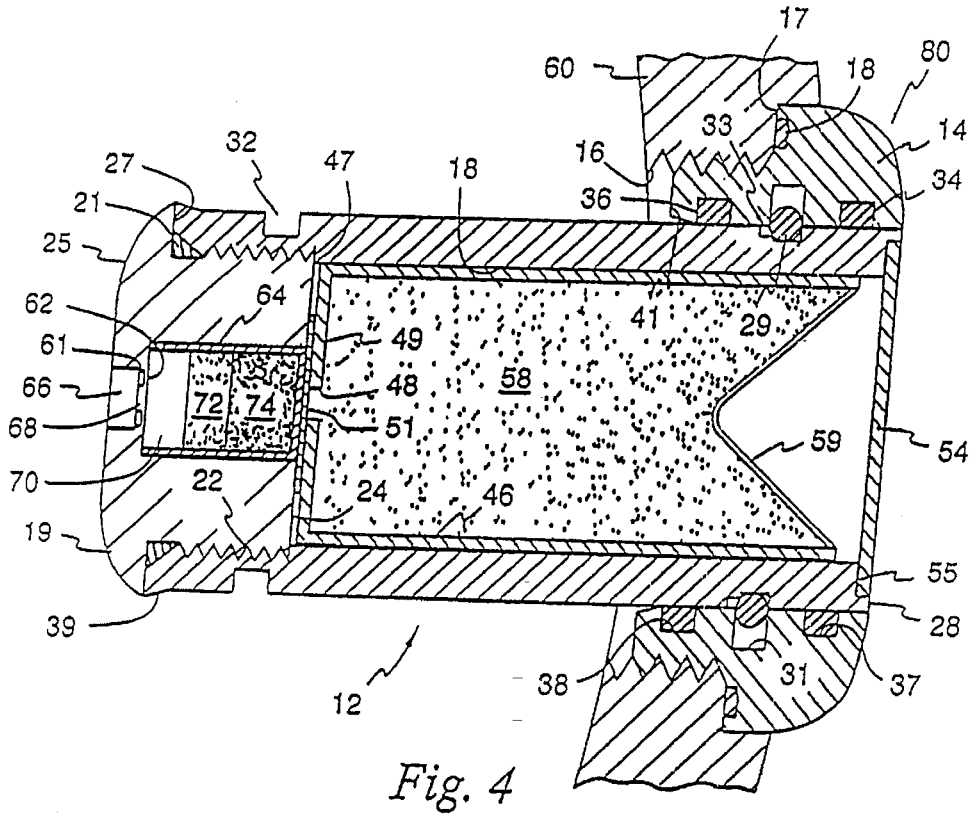
FIG. 4 is an enlarged cross-sectional view of a centralizer piston having a detonator device and shaped charge positioned therein, with the piston shown in a retracted or running-in position relative to the casing wall.
Figure 5:
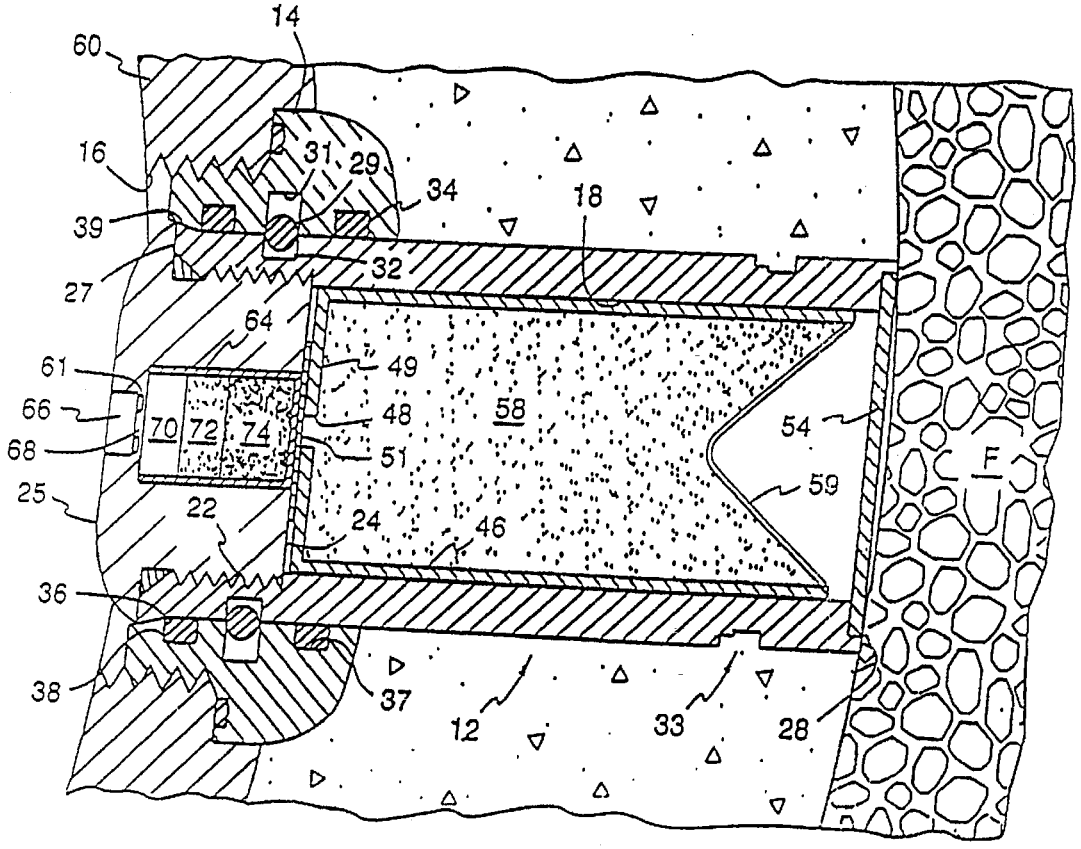
FIG. 5 is an enlarged cross-sectional view of the centralizer piston of FIG. 4 in an extended position wherein the outer end of the piston is in contact with an earth formation.

The centralizers or pistons may take many forms and shapes as is illustrated in Applicants' U.S. Pat. No. 5,228,518, incorporated herein by reference. In the present application, the piston or centralizer 50 is shown in FIGS. 4 and 5 as including an explosive charge for perforating formations in the borehole. Referring first to FIG. 4, the centralizer 50 has a cylindrical or substantially cylindrical barrel portion or piston 12 which is slidably received in a bore in button 14. The button 14 is threadedly received within a tapped hole 16 which extends transversely through the wall of casing 60. A bulbous or rounded outer portion 80 extends outwardly slightly beyond the outside wall of the casing 60 but only to provide an adequate seat for the button 14 in thin wall smaller diameter casing and is constructed so that the outer extension of the bulbous portion 80 does not exceed the maximum profile of the pipe string which would normally be represented by the outside diameter of collars 90 in the casing string. The button 14 has a shoulder 17 formed at the base of the bulbous outer portion 80 that provides a surface for seating within a mating recessed surface at the outer end of the threaded hole 16 in the casing wall. The shoulder 17 forms a vertical surface on the button which fits against the mating vertical surface at the outer end of hole 16. An O-ring 18 is arranged within a groove on the shoulder 17 to provide a seal between the shoulder 17 and a vertical face at the end of hole 16. The button 14 is arranged so that its inner end does not extend into the interior of the casing 60. The piston 12 is arranged for axial movement through the button 14 from a retracted position (FIGS. 3 and 4) to an extended position (FIGS. 2 and 5). The piston 12 and the button 14 are mounted into casing 60 so that their axis are collinear and directed radially outwardly with respect to the axis of the casing 60. The piston 12 includes a plug 19 secured in an interior bore or passageway 18 in the piston by screw threads 22. An annular sealing ring 21 is positioned between the plug 19 and the inner end of piston 12. The piston 12 shown in FIGS. 4 and 5 also serves as a housing for a perforating device. The plug 19 is called an initiator plug in that it carries a device for initiating detonation of a shaped charge in the piston. The plug 19 does not fill the entire passageway 18 but is rather approximately the thickness of the casing 60. The plug 19 further includes a rounded inner end face 25 and a flat distal end face 24. The rounded surface 25 on the inner end of plug 19 is provided for facilitating the use of a deploying device to push the centralizer 50 into an extended position.

The distal end 28 of the piston 12 may be chamfered or tapered inwardly to ease the installation of the piston 12 into the button 14. The piston 12 is mounted in a central bore in the button 14 which is preferably coaxial to the opening 16 in the casing 60 and is held in place by a snap ring 29. The snap ring 29 is located in a snap ring groove 31 milled in the wall of the interior bore of the button 14.

Piston 12 includes two radial piston grooves 32 and 33 formed in the exterior cylindrical surface of the piston 12. The first of the two piston grooves is a circumferential securing or locking groove 32 which is positioned adjacent the inner end 27 of piston 12 to be engaged by the snap ring 29 when the piston is fully extended. The second of the two grooves is a circumferential retaining groove 33 positioned adjacent the distal end 28 of the cylinder 12 to be engaged by the snap ring 29 when the piston is in the retracted or running position as shown in FIG. 4. As the piston 12 is illustrated in FIG. 5 in the extended position, the snap ring 29 is engaged in the radial locking groove 32.

The snap ring 29 is made of a strong resilient material arranged to expand into the snap ring groove 31 when forced outwardly and to collapse when unsupported into the grooves 32 and 33 when aligned therewith. The snap ring 29 is resilient as noted above so that it can be deflected deep into the snap ring groove 31 to slide along the exterior of the piston 12 and allow the piston 12 to move from the retracted position to the extended position. The snap ring 29 must also be strong to prevent the piston 12 from moving unless a sufficient activation force is applied to the piston 12 to deflect the snap ring 29 out of the retaining groove 33 into the snap ring groove 31 to permit the piston 12 to move through the snap ring to the extended position. The piston grooves 32 and 33 have a shape that in conjunction with the snap ring 29 allows the piston 12 to move in one direction but not the other. In the direction in which the snap ring 29 allows movement, the snap ring 29 requires an activation or deploying force of a certain magnitude before it will permit the piston 12 to move. The magnitude of the activation or deploying force depends on the spring constant of the snap ring 29, the relevant frictional forces between the snap ring 29 and the piston 12, the shape of the piston groove, and other factors. A particular arrangement of snap ring and grooves is shown in greater detail in U.S. Pat. No. 5,346,016, incorporated herein by reference.

Once the casing 60 is positioned in the wellbore for permanent installation, the pistons are deployed to the extended position. The deploying method provides a deploying force on the inner end of each piston to overcome the resistance of the snap ring in the retaining groove 33 and cause the snap ring 29 to ride up and out of the retaining groove 33 whereupon the snap ring 29 is pushed up into the snap ring groove 31 within the button 14. This allows the piston to move out into the annular space of the wellbore. Once the piston encounters the wellbore wall, it will then lift the casing off of the wellbore to centralize the casing until such time as the snap ring 29 aligns with and expands into the locking groove 32. The pistons should be of such a length that the pistons can be fully deployed to the locking groove 32 while giving the maximum amount of centralization. Once the pistons are fully deployed, the inner surface 25 on the plug 19 will be substantially clear of the casing bore for all practical purposes, and the casing bore should be substantially full opened.

The button 14 further includes a sealing arrangement to provide a pressure tight seal between the piston 12 and the button 14. In particular, the button 14 includes two O-rings, 34 and 36, which are positioned on either side of the snap ring 29 in O-ring grooves 37 and 38, respectively. The O-rings 34 and 36 seal against the exterior of piston 12 to prevent fluids from passing from one side of the casing wall to the other through the bore of the button 14. The O-rings 34 and 36 must slide along the exterior of the piston 12 passing the piston grooves 32 and 33 while maintaining the pressure tight seal. Accordingly, it is a feature of the preferred embodiment that the spacing of the O-rings 34 and 36 is such that as the piston 12 moves through the bore of the button 14 from the retracted position to the extended position, one of the O-rings 34 or 36 is in sealing contact with a smooth exterior surface of the piston 12 while the other may be opposed to one of the piston grooves 32 and 33.

The piston 12 further includes an outwardly tapered enlarged diameter peripheral edge 39 on its inner end 27, which edge 39 is larger than the bore in button 14 that receives the piston 12. Thus the edge 39 serves as a stop against the button 14 to limit the outward movement of the piston 12. The inside face of button 14 includes a chamfered edge 41 for engaging the outwardly tapered peripheral edge 39 on the piston when the inner end 27 of the piston is approximately flush with the inner end face of the button 14. Therefore, while the extended piston 12 is recessed into the button 14 and clear of the interior bore of the casing 60, the inwardly facing rounded surface 25 of the initiator plug extends slightly into the bore of the casing for purposes to be described so that it is substantially clear of the bore to render the casing bore fully open to permit passage of the deploying device 82 or other similar device such as packers or the like that would be passed through the bore of a casing string.

Still referring to FIG. 4, the inner bore 18 of the piston 12 is shown having a shaped charge insert installed therein. The shaped charge insert includes a cup-shaped canister or carrier 46 which is sized to be press fit into the bore 18 of the piston 12. A locking compound is used to hold the canister 46 in the bore cavity of the piston. The carrier 46 is nested against a shoulder 47 in the piston bore 18, the shoulder 47 being the end of the threads 22 which are cut in the bore 18 of the piston at its inner end to receive plug 19. An ignition hole 48 is formed in the inner wall 49 of the cup-shaped carrier 46. A thin metal foil 51 is placed over the outer surface of hole 48 facing the plug 19. At the distal end of the piston 12, an outer end cap 54 is fitted within a recessed shoulder 55 and is held in place by its press fit and a locking compound. The shaped charge 58 is positioned in the canister 46 with a conical depression and metal liner 59 in the distal end facing outwardly.

The opposite inner end of the piston 12 has the plug 19 enclosing the inner end. The plug 19 has a cylindrical recess 62 which is formed from the inner side of the plug 19 for receiving a detonator shell 64. The shell 64 is held in place within the recess 62 by means of a thread locking compound or the like. On the rounded outer surface 25 of the plug 19 and central to the plug 19, a recess 66 is formed in the outer wall surface 25 opposite the recess 62 on the interior of the plug 19. The recess 66 may be for example 3/16 inch in diameter and approximately 0.040 inches deep to leave an integral rupture disc portion 68 formed between the recesses 62 and 66. The rupture disc 66 may be on the order of 0.0275 inches thick. The shell 64 which is assembled within the recess 62 has provided within its interior bore a detonating system which is comprised of an optional air space 70, a primary charge of lead azide 72, and a base charge of RDX explosive 74.

Figure 8:
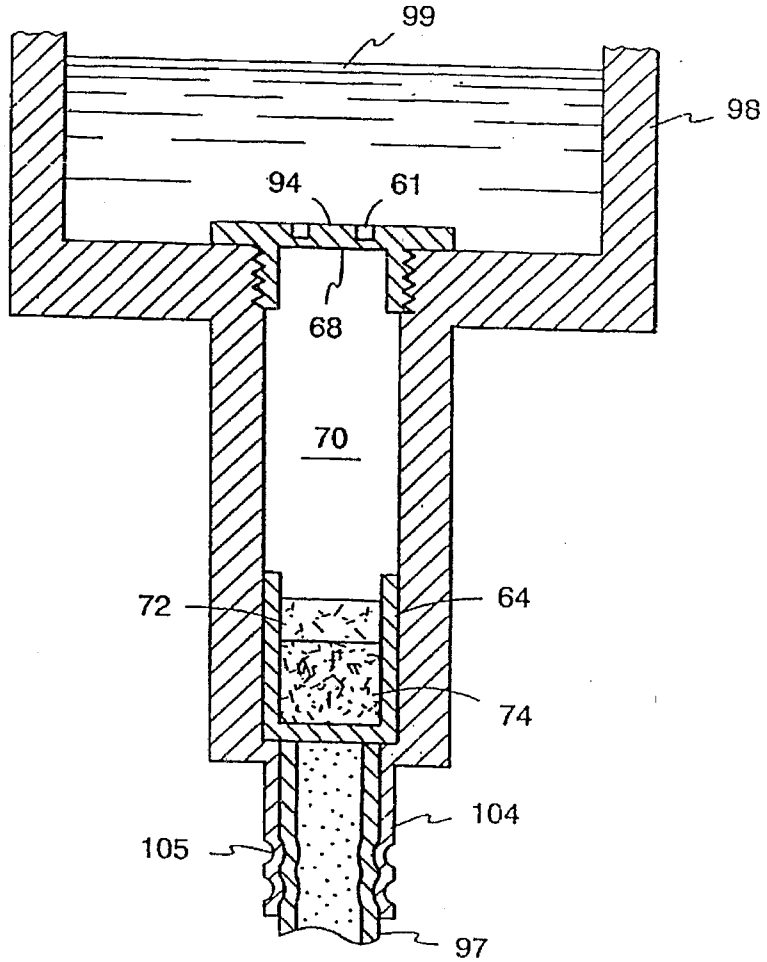
FIGS. 7 and 8 show alternative detonation devices for detonating an explosive in response to a pressure pulse.
Figure 7:
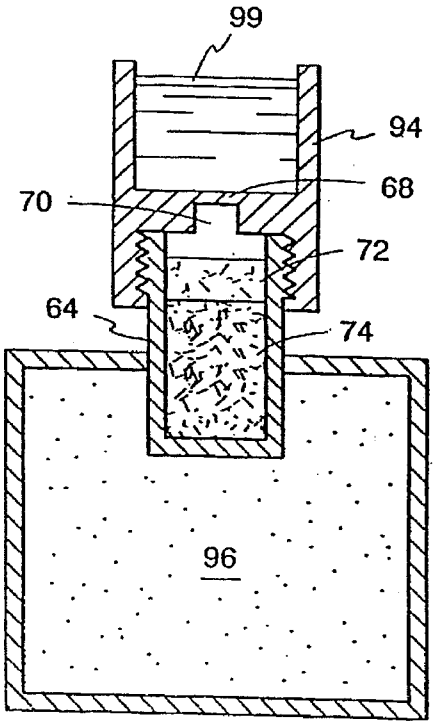

The fluid actuated detonator described above is particularly useful when incorporated into a holder with the explosive charge with which it is to be employed, such as the shaped charge 58 in centralizer pistons 12 shown in FIGS. 4 and 5. As so incorporated, the rupture disc 68 of the detonator is concealed from accidental activation. An alternative embodiment of the detonator in its most basic form is shown in FIGS. 7 and 8. The detonator comprises a generally tubular shell 64 which is closed at its bottom end. At least one base charge 74 of a detonating explosive composition is located in the bottom of the shell as shown, and a priming charge 72 of a heat sensitive explosive composition is located adjacent to the base charge. The embodiments shown in FIGS. 7 and 8 include an open volume 70 between the priming charge 72 and the rupture disc 68. The space between the top surface of the priming charge 72 and the rupture disc 68 is optional and can be any distance from about 0 to 279 mm (0 to 11 inches). Rupture disc 68 may be adapted by any suitable means known in the art to seal the end of the tubular shell 64. Typical base charges that can be used are pentaerythritol tetranitrate (PETN), cyclortrimethylene trinitramine, cyclotetramethylene tetranitramine, picrylsulfone, nitromannite, trinitrotoluene (TNT) and the like. Covering the base charge is a priming charge 72 that can be flat as shown or tapered and embedded in the base charge. Typical priming charges are of lead azide, lead styphanate, diazodinitrophenol, mercury fulminate and nitromannite. Mixtures of diazodinitrophenol/potassium chlorate, nitromannite/diazodinitrophenol and lead azide/lead styphanate also can be used. A separate layer of lead styphanate or a layer of a mixture of lead styphanate can be placed over lead azide. The tubular shell 64 and the rupture disc 68 can be aluminum, magnesium brass or any metal, plastic, or other suitable material.

The detonator of FIG. 7 is shown having an explosive charge 96 which represents a booster charge or a main charge to be detonated by the detonating charge in shell 64. A housing 94 extending upwardly from shell 64 contains a fluid medium 99 which serves as a transmission means for conveying a pressure wave or pulse to the rupture disc 68. In FIG. 8 the fluid medium 99 is contained in a housing 98 which has a lower detonator portion to house detonator shell 64. The lower end of the detonator portion of housing 98 has an extension 104 which securably receives a detonating cord 97. Crimps 105 may be provided to hold the cord 97 within the lower end 104 of housing 98 in proximity to the detonator shell 64.

In the detonator arrangement of FIGS. 4 and 5 the rupture disc includes a circular groove 61 formed inwardly into the plug 19 from the recess 66. This groove 61 can be formed on either or both sides of the rupture disc 68. In order to accommodate this groove 61, the rupture disc 68 is made thicker so as not to unnecessarily weaken the integrity of the barrier 68 that protects the detonator shell 64. By undercutting the circular groove or rim 61 around the circumference of the rupture disc 68, the disc 68 will yield more predictably than by relying solely on normal yield of the metal between the recesses 66 and 62. This in turn improves initiation reliability. Also, a thicker disc 68 can be provided between the recesses 66 and 62 to protect the detonator from inadvertent activation by movement of a piston activating or extending device 82 through the casing bore.

In FIG. 5 of the drawings, the centralizing piston 12 is shown having been moved to an extended and locked position wherein the distal end 28 of the piston is in contact with the bore hole wall. A deploying device 82 such as is shown in FIG. 1 has been moved through the interior bore of the casing string to contact the outer surface 25 of plug 19 on the inner end of the piston. As the deploying device 82 passes the position in the casing string where the cylinder is positioned, the cylinder is forced outwardly with sufficient force to override the restraining effect of the snap ring 29 in the retaining groove 33. This overriding force causes the snap ring to move upwardly and expand outwardly into the groove 31 as it expands over the outer surface of the piston 12. The piston continues its movement until the tapered enlarged portion 39 on piston 12 abuts the mating chamfered surface 41 on the button 14 whereupon the piston 12 is positioned so that the snap ring 29 retracts into the locking groove 32 to hold the extended cylinder 12 in a predetermined fixed position. At this point, the deploying device 82 (FIG. 1) will have passed the extended piston 12 and proceeded downwardly through the casing string. Once the piston is extended and locked in its predetermined fixed position as shown in FIG. 5, the perforating apparatus is now in a position to permit perforation of the formation which the wellbore traverses. It is noted, that alternatively the pistons 12 may be extended by the application of hydraulic pressure to the interior of the casing pipe string which provides a force that impinges on the inner end of the piston to move the pistons outwardly.

It is to be noted that one particular advantage of the apparatus described herein is that the centralizing piston and a button 14 which guides the piston, when provided, may be assembled within the casing string at some time just before the casing is run into the wellbore W. Accordingly, the handling of the casing pipe up to the point that it is being installed in the wellbore is not subjected to the danger which would be caused by having the explosive devices installed during shipping and handling of the casing prior to its installation. It is also to be noted that there is no means present within the system thus far described to accidentally initiate the detonator device within the piston so that such handling in the configuration described above is considered safe and will not unnecessarily endanger the personnel who are installing the devices in the casing or installing the casing within the wellbore.

Figure 6:
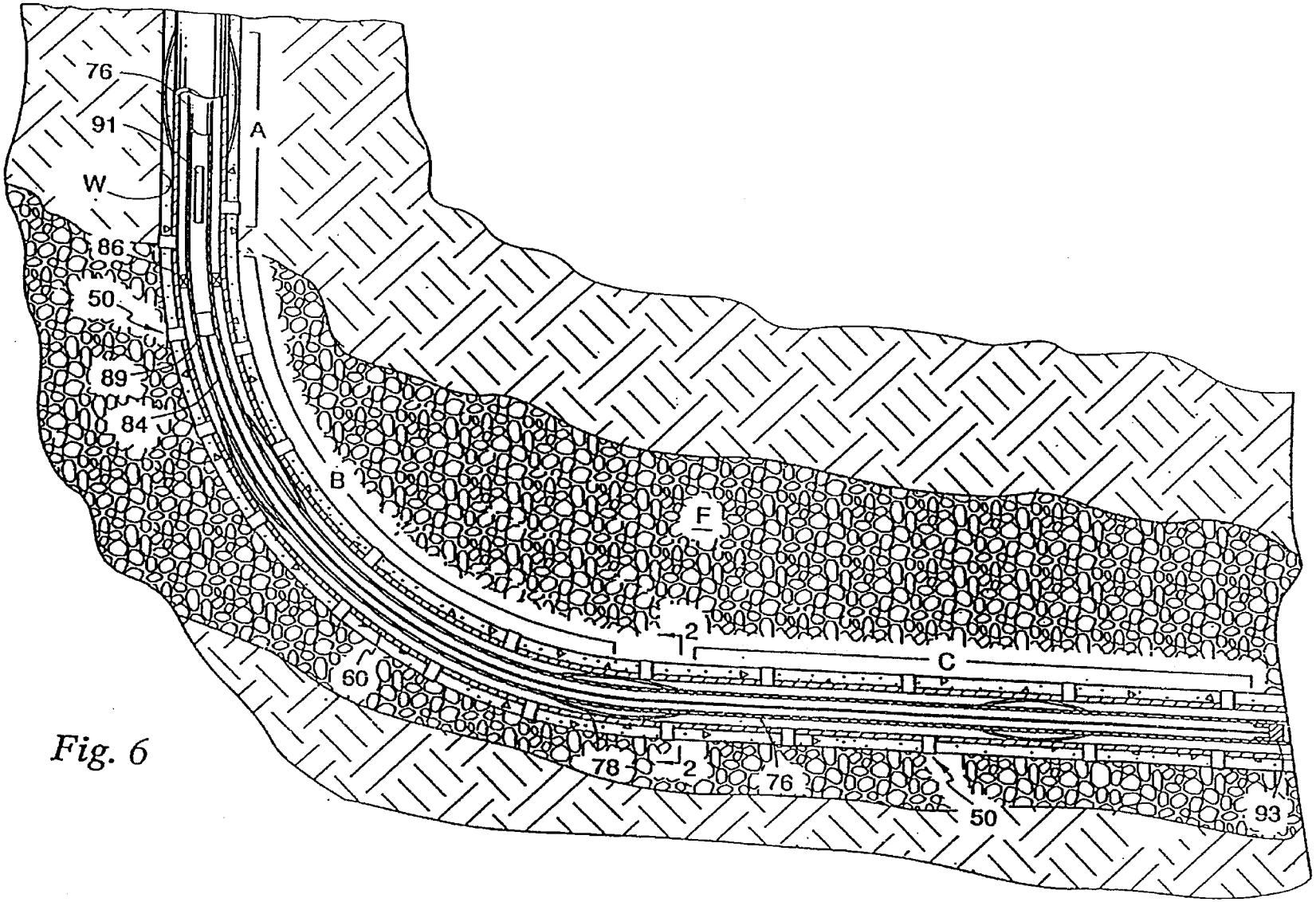
FIG. 6 is a cross-sectional view of a wellbore showing a casing centralized in a borehole by pistons in an extended position and further showing a pressure pulse generating device positioned in the casing by means of a pipe string.

Referring now to FIG. 6 of the drawings, the casing 60 is shown having been run into a well. The centralizers are shown having been extended by means of a pumpable activator device 82 such as shown in FIG. 1 or by the application of hydraulic pressure to the casing string at the surface. This is accomplished by closing a valve at the base of the casing string and applying the necessary activation or deploying force required to move the pistons from the retracted position to the extended position. Accordingly, pumps or other pressure generating mechanism would provide the necessary deploying force for the pistons.

Once the casing has been centralized within the wellbore, an annulus of cement can be injected and set around the entire outer periphery of the casing, over some appropriate interval of casing, to seal the casing from the formation. As suggested by the present invention, the casing string with the centralizer system as described is arranged so that in those portions of the wellbore where it is desired to have a centralizing only function for the centralizers, the centralizers are not configured so as to provide a perforating function. However, within a zone opposite formation F as shown in FIG. 6, where it is desirable to open the casing to permit the recovery of fluids from the formation into the casing string and to perforate the formation, the centralizers are of the embodiment shown in FIGS. 4 and 5 which include a shaped charge device or the like for perforating the formation to be produced.

In the initial installation of the casing within the wellbore, it is important to note that the centralizers which are not extended permit the casing to be rotated and reciprocated to work past tight spots or other interferences in the hole. These retracted centralizers 50 also do not interfere with the fluid path through the casing string so that fluids may be circulated through the casing to clear cuttings from the end of the casing string. Also the casing interior can be provided with fluids that are less dense than the wellbore fluids, in the annular space, causing the casing string to float. Clearly, the centralizers 50 of the present invention permit a variety of methods for installing the casing into its desired location in the wellbore.

Once the casing 60 is in a suitable position, the centralizers are deployed to centralize the casing. As discussed above, there are several methods of deploying the centralizers. Once the pistons are all deployed and the snap rings have secured them in the extended fixed position projecting outwardly toward the wall of the wellbore, the cement may be injected by well known techniques into the annulus formed by the centralizing of the casing within the borehole.

The cement around casing 60 may be allowed to set while the production string is assembled and installed into the casing. It is important to note that at this point in the process of establishing the well, the casing and wellbore are sealed from the formation. Accordingly, there is as yet no problem with controlling the pressure of the formation or with loss of pressure control fluids into the formation. In a conventional completion process, the perforation string is assembled to create perforations in the casing adjacent to the hydrocarbon bearing zone. Accordingly, high density fluids are provided in the wellbore and the production string to maintain a sufficient pressure head against the affect of formation pressure to avoid a blowout situation. While the production string is assembled and run into the well some of the wellbore fluids, in an overbalance condition, may be forced into the formation. Accordingly, the production string must be installed quickly to begin producing the well once the well has been perforated. However, with the present invention, such problems are avoided. Once the casing is set in place, the production string may be assembled and installed in the casing before the casing is opened and perforation of the formation is performed. If the production string is already in place in the well, adequate surface controls are already in place to prevent a blowout, so that the casing and production string can be in an underbalanced condition. Thus, production may begin when communication is established with the formation, such as by perforation. Accordingly, the well is brought on-line in a more controlled manner.

FIG. 6 shows an apparatus and system for initiating the detonators 64 (FIG. 5) in the pistons, in order to fire the shaped charges and penetrate the formation. A small diameter pipe string such as production tubing 76 or coiled tubing is run into the interior of the casing string after the centralizers 50 are extended. The casing pay or may not be cemented in place. A detonating cord 84 may be preinstalled in the lower end of the tubing string 76 and run into the well with the tubing string. Alternatively, the tubing string may be located in the casing string and then the detonating cord is run into the tubing string. In the latter case, in order to set the detonating cord 84 in place, the bottom of the tubing string could be provided with a latching mechanism 93. After the tubing 76 is run into the casing string, a sinker bar with detonating cord trailing behind, can be lowered into the tubing string and latched inside of the tubing. Alternatively, a device can be pumped to the latch 93 with a detonating cord trailing. A perforating head 89 would be run at the trailing, upper end of the detonating cord 84 to provide a means for initiating the detonating cord. Once the tubing is run, a production packer 86 can be set. At this time a sinker bar 91 can be dropped which would strike the perforating head and initiate the detonating cord. Alternatively, a wireline could be connected with the detonating cord or perforating head in order to initiate the detonating cord.

The detonating cord is initiated by dropping a latch bar 91 or using a wireline to initiate a perforating head or as another alternative, using a hydraulically actuated perforating head 89. Once the detonating cord is initiated, it results in the development and propagation of a pressure pulse or wave within the pipe string 76. This pressure wave is then communicated through the fluid in the pipe 76 and casing 60 to the plug 19 at the inner end of the cylinders 12. If necessary, the pipe string 76 may be centered in the casing by means of conventional centralizers 78. Centering the pipe string 76 in the casing string may be important in view of the importance of propagating a pressure wave to the cylinders 12 on all sides so that the force of this pressure wave is sufficient to rupture membrane or disc 68 in the plug 19. This rupture of disc 68 sequentially initiate the powders 72 and 74 within the shell 64 positioned in the plug 19. Tests have shown that initiation of the detonator will take place reliably without the provision of an air space 70 in the shell 64. The amount of pressure required to rupture the disc is increased when the air space is eliminated; however, detonation does take place. Satisfactorily, it is believed that the principle behind the detonation is an adiabatic compression within the shell 64 which is sufficient to initiate the primary charge 72. Therefore, it appears to only be necessary to generate sufficient pressure within the interior of the casing bore to cause the ruptured disc 68 to rupture which will thereby initiate the detonator in the shell 64. When a shaped charge is present in the piston 12, initiation of the detonator is communicated through the opening 48 within the carrier 46 to detonate the shaped charge 58. This detonation produces a penetrating force that is directly applied to the formation F so that all the outwardly directed energy of the shaped charge is applied to perforation and fracturing of the formation.

In the configuration shown in FIG. 6, the smaller diameter pipe 76 housing the detonating cord, may be provided with slots or holes in the outside walls thereof to facilitate transmission of a pressure wave emanating from the detonating cord to the perforating cylinders 12. However, experiments have shown that a pressure wave may be propagated through the walls of solid pipe which is sufficient to initiate the detonators within the plug 19 on the cylinders 12. The system shown in FIG. 6 with a production packer 86 set in place will permit the completion to take place with an under-balanced fluid in the pipe string, so that upon perforation of the formation F formation, fluids may be readily received into the casing string through the now open cylinder 12 and from there into the production tubing 76 for conveyance to the surface.

Referring now to FIGS. 7 and 8 of the drawings, an alternative system for detonating the perforators includes a pumpdown arrangement for positioning a detonating cord within the interior of a casing string. An important feature of this centralizing and perforating system is that the perforators are not armed when they are installed in the casing string, nor when they are positioned in the borehole. A means is thus provided for initiating the perforators after they are located within the wellbore. In this embodiment, a detonating cord is again provided to generate a pressure wave which in turn ruptures the protective membrane or disc 68 on the end of the plug 19 within the perforating cylinder 12, with such rupturing of the membrane causing the detonator explosives to fire. Firing of the detonator explosives will initiate firing of the shaped charge. The detonating cord 104 is carried in a housing 94 which is attached to a displacement plug 96. The plug 96 may be pumped down behind cement being injected into the annulus to isolate the casing string from the formation. The detonating cord 104 is shown in FIG. 7 coiled up within the housing 94 which is releasably attached to the pumpdown plug 96. An electrical wireline or the like 98 which is attached to the housing 94 is pulled into the casing string through a stuffing box (not shown) at the surface. Once the displacement plug 96 and housing 94 reaches the bottom of the casing string, it lands in a seat 102 whereupon a pressure increase in the casing is registered at the surface to indicate that the plug has seated at the bottom of a casing string in the seat 102 and sealed off the end of the casing at least partially. The seat 102 provides a latching mechanism (not shown) for holding the seated plug 96 in place. Such displacement plugs and latching mechanisms are commonly used in cementing operations. Thereafter the wireline 98 is pulled upwardly as shown in FIG. 8 to release the housing 94 from the displacement plug 96. The detonating cord 104 which is positioned within the housing and which is attached to the displacement plug 96 is then pulled out behind the upwardly moving housing 94 a sufficient distance to ensure that the detonating cord is positioned within the pipe string opposite the centralizer/perforators which are to be activated by a pressure wave. The upper end of the detonating cord is attached within the housing 94 to an electrically operated detonator (not shown) on the end of the electric wireline 98. When the displacement plug 96 lands at the bottom and we know that all the cement in the pipe string is displaced, 24 to 48 hours is given for the cement to set up. After the cement has set up, an electrical current is passed from the surface through the wireline 98 for detonating cord detonation. Firing of the detonating cord generates a pressure wave within the casing pipe 60 which in turn impinges upon the rupture disc or membrane 68 in the end of piston 12 to fire the detonating mixtures 72, 74 within the detonator cup. This detonation in cup 64 passes energy through the opening 48 within the carrier 46 to initiate a burning of the shaped charge 58 within the cylinder 12. This in turn causes the shape charge 58 to penetrate into the formation F and to develop a communication path between the interior of the casing string and the formation.

In the process of perforating the formation as described in the present invention, it is noted that the word "penetrating" is used to describe the process for opening a communication path into the formation. The reason that penetrating the formation is desirable is that the permeability of porous reservoir rock is usually reduced or plugged near the wellbore due to the leakage of drilling fluids into the first few inches of rocks surrounding the wellbore. This reduces permeability near the wellbore and is referred to as skin damage. In the present perforating technique, the shaped charges are not designed to punch a hole in the casing as in a normal perforating system, but rather to establish communication with the reservoir rock and to penetrate the rock itself with a fracturing and penetrating blast that extends communication beyond the skin damage. Whereas normal shaped charges in a perforating system are positioned within the casing string and must therefore progress through the fluids within the casing string, the steel casing string wall, and then into the skin damaged portion of the reservoir. In the present system the shaped charge is positioned directly against the formation and thus a much greater portion of the energy developed by the shaped charge is applied to the formation rock itself.

It is readily appreciated that various other techniques could be developed for providing the placement of a detonating cord into the interior of either a casing pipe string or a production string in order to initiate the pressure wave described herein for detonating the perforation devices. For example, the detonating cord could be pumped in behind a pumpable plug or the like to position the detonating cord into a horizontal reach of pipe. In a vertical or nearly vertical pipe section, gravity would be sufficient to lower a detonating cord weighted on its lower end, into a pipe string. In addition other methods could be used to develop a pressure wave for initiating the shaped charge. Also, it is readily seen that a variety of detonators might be used to initiate the explosion of the shaped charged within the centralizing cylinder 12. Therefore, while particular embodiments of the present invention have been shown and described, it is apparent that changes and modifications may be made without departing from this invention in its broader aspects and therefore the aim in the appended claims is to cover all such changes and modifications as fall within the true spirit and scope of this invention.

We claim:

1. A fluid activated detonating system comprising:

housing means, wherein at least a portion of the housing means is in communication with a fluid environment;

detonator means in said housing, said detonator means being activated in responsive to a pressure pulse;

rupture means closing a portion of said housing which would otherwise communicate said detonator means with the fluid environment; and explosive means for generating a pressure wave in said fluid environment to rupture said rupture means and thereby expose said detonator means to a pressure pulse.

2. The detonating system of claim 1, wherein said rupture means is a rupture disc that includes a membrane that seals an opening in said housing against fluidic pressure.

3. The detonating system of claim 1, wherein said detonator means includes a primary charge and a base charge, said base charge being initiated by activation of said primary charge.

4. The detonating system of claim 1 wherein said explosive means for generating a pressure wave within the fluid environment is a detonating cord in said fluid environment.

5. The detonating system of claim 1, wherein said housing means is arranged in the sidewall of a pipe for positioning in a borehole.

6. The detonating system of claim 5, and further including shaped charge means arranged in the sidewall of the pipe adjacent said housing means.

7. The detonating system of claim 1, wherein said detonator means is comprised sequentially of a top layer of a primary charge and a bottom layer of a secondary explosive material.

8. The detonating system of claim 7 where the secondary explosive is a more stable compound selected from the group of pentaerythritol tetranitrate (PETN), cyclotrimethylene trinitramine, cyclotetramethylene tetranitramine, picrylsulfone, nitromannite, trinitrotoluene (TNT).

9. The detonating system of claim 6, wherein said housing means has a first chamber for carrying said detonator means and a second chamber for carrying said shaped charge means.

10. The detonating system of claim 9, including a plurality of said shaped charge means are arranged in the pipe.

11. A method of detonating an explosive device in a fluid environment, comprising the steps of:

providing a housing for an explosive device, wherein the housing has a rupture portion that is weakened to permit rupture at a predetermined fluid pressure outside said housing; said housing having a detonator charge arranged therein, which detonator charge is activated by a sudden exposure to pressure and wherein said housing is arranged in the wall of a pipe:

positioning the pipe in a borehole penetrating earth formations; and generating a pressure wave in the borehole to increase the pressure on the exterior of the housing to rupture the rupture portion on the housing and suddenly expose the detonator charge to the force of the pressure rupturing said rupture portion.

12. The method of claim 11 and further, wherein said housing also includes another explosive device, wherein activation of said detonator charge initiates said another explosive device.

13. A detonating system for use in a wellbore comprising;

housing means for carrying a detonator charge into the wellbore, said housing means having at least one opening therein;

rupture means covering said at least one opening, said rupture means arranged for rupturing when subjected to a pressure pulse;

said detonator charge arranged to be detonated in response to rupture of said rupture disc by a sudden pressure pulse generated outside said housing; and shaped charge means in said housing means and activatable in response to detonation of said detonator charge.

14. The detonating system of claim 13 and further including detonating cord means outside said housing for generating a pressure pulse in said wellbore to rupture said rupture means.

15. A fluid activated detonating system comprising:

housing means wherein at least a portion of the housing means is in communication with an external fluid environment;

said housing means enclosing at least one explosive charge, said explosive charge being activated in response to a pressure wave;

at least one portion of said housing means being in the form of a rupture means;

said rupture means being in communication with said external fluid environment;

explosive means for generating a pressure wave in said external fluid environment to breach said rupture means and thereby expose said explosive charge to the pressure wave.

* * * * *